US005141705A

United States Patent [19]

Stenvall et al.

[11] Patent Number: 5,141,705

[45] Date of Patent: Aug. 25, 1992

[54] AUSTENITIC STAINLESS STEEL

[75] Inventors: Peter Stenvall; Mats Liljas; Bengt Wallén, all of Avesta, Sweden

[73] Assignee: Avesta Aktiebolag, Avesta, Sweden

[21] Appl. No.: 637,144

[22] Filed: Jan. 3, 1991

[30] Foreign Application Priority Data

Jan. 15, 1990 [SE] Sweden ..... 9000129

[51] Int. Cl.[5] ..... C22C 38/44; C22C 30/00

[52] U.S. Cl. ..... 420/584; 420/46; 420/52

[58] Field of Search ..... 420/46, 52, 584.1

[56] References Cited

U.S. PATENT DOCUMENTS 4,086,085 4/1978 McGurty ..... 420/46

*Primary Examiner*—Deborah Yee

*Attorney, Agent, or Firm*—Nixon & Vanderhye

[57] ABSTRACT

The invention relates to an austenitic stainless steel having a high tensile strength, a high impact strength, a good weldability and a high corrosion resistance, particularly a high resistance to pitting and crevice corrosion. The steel contains in weight-%:

max 0.08 C
max 1.0 Si
more than 0.5 but less than 6 Mn
more than 19 but not more than 28 Cr
more than 17 but not more than 25 Ni
more than 7 but not more than 10 Mo
0.4–0.7 N
from traces up to 2 Cu
0–0.2 Ce
balance essentially only iron, impurities and accessory elements in normal amounts.

27 Claims, No Drawings

AUSTENITIC STAINLESS STEEL

TECHNICAL FIELD

This invention relates to an austenitic stainless steel having a high tensile strength, a high impact strength, a good weldability and high corrosion resistance, particularly a high resistance to pitting and crevice corrosion.

BACKGROUND OF THE INVENTION

When the stainless austenitic steel grade Avesta 254 SMO®, which contains slightly more than 6% molybdenum (U.S. Pat. No. 4,078,920) was introduced on the market more than ten years ago, it involved an important technical achievement, namely that the corrosion and mechanical strength features were considerably improved in comparison with high alloyed steels existing at that time. Today, ferritic and ferritic-austenitic steels having approximately the same corrosion resistance as grade Avesta 254 SMO® are also commercially available.

A way of improving the corrosion resistance of an austenitic stainless steel is to include nitrogen in the alloy composition. Nitrogen has been utilized already in the above mentioned steel grade Avesta 254 SMO®, which contains a little more than 0.2% nitrogen. It is also known that the solubility of nitrogen can be further increased if the content of manganese or chromium is increased in the steel composition.

However, there are many fields of use where the best stainless steels available today have unsufficient corrosion resistance. This particularly concerns the use for corrosive chloride solutions, where the risk of pitting and crevice corrosion is pronounced, and also the use in strong acids. For such applications it is therefore necessary to use very expensive materials, such as nickel base alloys. Therefore, there is a demand for a material which is cheaper than nickel base alloys but which has a corrosion resistance, and particularly a pitting and crevice corrosion resistance, which is at least at a level with the corrosion resistance of nickel base alloys.

In order to achieve the improved corrosion resistance which is desirable for conduits, apparatus, and other devices used for example in the off-shore industry, and for heat exchangers and condensors, it is necessary that the total amount of those alloying elements which improve the corrosion resistance is considerably increased in comparison with the high alloyed austenitic stainless steel existing today, e.g. of type grade Avesta 254 SMO®. However, high contents of chromium and molybdenum, which are very important alloying elements in this connection, will increase the susceptability of the steels to precipitation of inter-metallic phases. This may, if the precipitation susceptability is pronounced, cause problems in the production of the steels and also in connection with welding, and may also impair the corrosion resistance.

A means of reducing or avoiding the precipitation of inter-metallic phases is to alloy the steel with a high content of nitrogen. At the same time nitrogen may improve the pitting and crevice corrosion resistance of the steel. However, chromium has a high affinity for nitrogen and it readily forms chromium nitrides when the contents of chromium and nitrogen are too high, which creates another problem in connection with these steels. In order to achieve high nitrogen content in austenitic stainless steels, it is also necessary that the solubility to nitrogen in the molten phase of the steel is sufficiently high. An improved nitrogen solubility in the molten phase may be achieved through increased contents of chromium and manganese. High amounts of chromium, however, may give rise to the formation of chromium nitrides, as above mentioned. Previously, very high amounts of manganese to the steel have often been added, i.e. more than 6% manganese, in order to increase the nitrogen solubility of the steel, so that nitrogen contents exceeding 0.4% may be achieved. Such high manganese contents as 6% in turn, however, may cause certain problems. Thus, they may make the decarburisation of the steel more difficult and also cause wear on the lining of the steel converter.

SUMMARY OF THE INVENTION

It is therefore an object of this invention to provide a weldable austenitic stainless steel having high tensile strength, high impact strength and a pitting and crevice corrosion resistance which is comparable with several of today's nickel base alloys.

Particularly, the invention aims at providing a steel which advantageously can be used for example within the following fields:

- in the off-shore industry (sea water, acid oil and gas)
- for heat exchangers and condensors (sea water)
- for desalination plants (salt water)
- for flue-gas purification equipment (chloride containing acids)
- for flue-gas condensing apparatus (strong acids)
- for plants for the production of sulphurous acid or phosphoric acid
- for pipes and apparatus for oil and gas production (acid oil and gas)
- for apparatus and pipes in cellulose bleaching plants and in chlorate production plants (chloride containing, oxidizing acids or solutions, respectively)
- for tankers and petrol trucks (all kinds of chemicals).

It has now been found, according to the present invention, that nitrogen contents exceeding 0.4% may be achieved with significantly lower manganese contents. It has also been found that manganese will reduce the corrosion resistance of the steel. Therefore it is preferably also a specific purpose of the invention to provide an alloy composition of the steel in which the desired high nitrogen content may be achieved together with a comparatively moderate content of manganese in the steel.

The steel of the present invention therefore contains in weight-%:

max 0.08 C
max 1.0 Si
more than 0.5 but less than 6 Mn
more than 19 but not more than 28 Cr
more than 17 but not more than 25 Ni
more than 7 but not more than 10 Mo
0.4–0.7 N
from traces up to 2 Cu
0–0.2 Ce
balance essentially only iron, impurities and accessory elements in normal amounts.

DETAILED DESCRIPTION OF THE INVENTION

Besides the mentioned alloying element, the steel also may contain other elements in minor amounts, provided these elements do not impair the desired features of the steels which have been mentioned above. For example, the steel may contain boron in an amount up to 0.005% for the purpose of further increasing the hot workability of the steel. If the steel contains cerium, it normally also contains other rare earth metals, as these elements including cerium, normally are supplied in the form of mischmetal. Further, also calcium, magnesium or aluminium may be added to the steel in amounts up to 0.01% of each element for different purposes.

As far as the different alloying elements are concerned, the following will apply.

Carbon is considered as a non-desired element in the steel of the invention, since carbon strongly reduces the solubility of nitrogen in the molten steel. Carbon also increases the tendency to precipitation of harmful chromium carbides. For these reasons carbon should not be present in the steel in amounts exceeding 0.08%, preferably not exceeding 0.05%, and suitably not exceeding 0.03%.

Silicon increases the tendency for precipitation of inter-metallic phases and reduces strongly the solubility of nitrogen in the molten steel. Silicon therefore may exist in an amount of max 1.0%, preferably max 0.7%, suitably max 0.5%.

Chromium is a very important element in the steel of the invention, as well as in all stainless steels. Chromium generally increases the corrosion resistance. It also increases the solubility of nitrogen in the molten steel more strongly than other elements in the steel. Chromium therefore is present in the steel in an amount of at least 19%.

Chromium, however, particularly in combination with molybdenum and silicon, increases the susceptibility to precipitation of inter-metallic phases and in combination with nitrogen also the susceptibility to precipitation of nitrides. This may be critical for example in connection with welding and heat treatment. For this reason, the chromium content is limited to max 28%, preferably to max 27%, suitably to max 26%.

Molybdenum belongs to the most important elements in the steel of the invention due to its ability to strongly increase the corrosion resistance, particularly the resistance to pitting and crevice corrosion, at the same time as increasing the solubility of nitrogen in the molten steel. Also the tendency to precipitation of nitrides is diminished with increased content of molybdenum. The steel therefore contains more than 7.0% molybdenum, preferably at least 7.2% Mo. It is true that problems may be expected in connection with hot rolling and cold rolling because of such a high content of molybdenum, but by a proper selection and adaptation of other alloying elements in the steel according to the invention it is possible to hot roll and to cold roll the steel successfully even with the high molybdenum contents which are typical for this steel. However, problems may arise in connecting with the hot workability if the molybdenum content is too high. Furthermore, molybdenum has a tendency to increase the susceptibility to precipitation of inter-metallic phases, e.g. in connection with welding and heat treatment. For these reasons, the molybdenum content must not exceed 10%, preferably not exceed 9%, and suitably not exceed 8.5%.

Nitrogen is a critical alloying element in the steel of the invention. Nitrogen very strongly increases the pitting and crevice corrosion resistance and it also strongly improves the mechanical strength of the steel, while at the same time maintaining good impact strength and deformability (shapeability). Nitrogen also is a cheap alloying element, as it can be added to a steel by adding air or nitrogen gas to the oxidizing gas in connection with the decarburization of the steel in the converter.

Nitrogen is also a strong austenite stabilizer, which affords several advantages. In connection with welding, some alloying elements may strongly segregate. This particularly concerns molybdenum, which exists in a high amount in the steel of the invention. In the inter-dendritic regions the molybdenum contents often may be so high that the risk for precipitation of inter-metallic phases is very great. During our research work with the steel of this invention we have surprisingly found that the austenite stability is so high that the inter-dendritic regions, in spite of the very high contents of molybdenum, will maintain their austenitic micro-structure. The high austenite stability is advantageous, e.g. in connection with welding without consumable electrodes, since it will result in the material in the weld containing extremely low contents of secondary phases and consequently a higher ductility and corrosion resistance.

The inter-metallic phases which most commonly may occur in this type of steel are Laves's phase, sigma-phase, and chi-phase. All these phases have a very low or no solubility at all of nitrogen. Nitrogen for this reason may delay the precipitation of Laves's phase and also of sigma- and chi-phase. A higher content of nitrogen thus will increase the stability against precipitation of the said inter-metallic phases. For the above reasons, nitrogen is present in the steel in an amount of at least 0.4%, preferably at least 0.45% N.

If the nitrogen content is too high, however, the tendency to precipitation of nitrides is increased. High nitrogen contents moreover will impair the hot workability. The nitrogen content in the steel therefore must not exceed 0.7%, preferably not exceed 0.65%, and suitably not exceed 0.6% N.

Nickel is an austenite forming element and is added in order to establish the austenitic microstructure of the steel in combination with other austenite formers. An increased nickel content also counteracts the precipitation of inter-metallic phases. For these reasons, nickel is present in the steel in an amount of at least 17%, preferably at least 19%.

Nickel, however, lowers the solubility of nitrogen in the molten state of the steel and it further increases the tendency to precipitation of carbides in the solid state. Furthermore, nickel is an expensive alloying element. Therefore the nickel content is restricted to max 25%, preferably max 24%, suitably max 23% Ni.

Manganese is added to the steel in order to improve the solubility of nitrogen in the steel in a manner known per se. The research work in connection with the development of the steel has revealed that surprisingly low manganese contents are sufficient for making possible nitrogen contents exceeding 0.4%.

Manganese therefore is added to the steel in an amount of at least 0.5%, preferably at least 1.0%, and suitably at least 2.0% in order to increase the solubility of nitrogen in the molten state of the steel. High contents of manganese, however, cause problems during decarburization, since manganese like chromium reduces the carbon activity, so that the decarburization rate is slowed down. Manganese furthermore has a high vapour pressure and a high affinity to oxygen which results in a considerable loss of manganese during decarburization if the initial content of manganese is high. It is further known that manganese may form sulphides which lowers the resistance to pitting and crevice corrosion. The research work in connection with the development of the steel of the invention furthermore has shown that manganese dissolved in the austenite impairs the corrosion resistance even if manganese sulphides are not present. For these reasons, the manganese content is restricted to max 6%, preferably to max 5%, suitably to max 4.5%, and most suitably to max 4.2%. An optimal content of mangenese is appr. 3.5%.

It is known that copper in some austenitic stainless steels may improve the corrosion resistance against some acids, while the resistance against pitting and crevice corrosion can be impaired in the case of higher amounts of copper. Copper therefore may occur in the steel in amounts significant for the steel up to 2.0%. Extensive research work has revealed that there exists a copper content range which is optimal if corrosion characteristics in different media are considered. Copper therefore preferably is present within the range 0.3-1.0%, suitably in the range 0.4-0.8% Cu.

Cerium may optionally be added to the steel, e.g. in the form of mischmetal, in order to increase the hot workability of the steel in a manner known per se.

If mischmetal has been added to the steel, the steel besides cerium also contains other rare earth metals. Cerium will form ceriumoxysulphides in the steel, which sulphides do not impair the corrosion resistance to the same degree as other sulphides, e.g. manganese sulphide. Cerium is therefore present in the steel in significant amounts up to max 0.2%, suitably max 0.1%. If cerium is added to the steel, the cerium content should be at least 0.03% Ce.

Sulphur must be kept at a very low level in the steel of the invention. A low content of sulphur is important for the corrosion resistance as well as for the hot working features of the steel. The content of sulphur therefore may be at most 0.01%, and, particularly for the purpose of achieving a good hot workability, the steel preferably should have a sulphur content less than 10 ppm (<0.001%) considering that an austentic stainless steel having as high contents of manganese and molbdenum as the steel of the invention normally is very difficult to hot work.

Preferred and suitable ranges of composition for the various alloying elements are listed in Table 1. Balance is iron and impurities and accessory elements in normal amounts.

TABLE 1

| | Preferred range of composition, weight-% | Suitable range of composition, weight-% |
|---|---|---|
| C | max 0.05 | max 0.03 |
| Si | max 0.3 | max 0.5 |
| Mn | 2-5 | 3.0-4.5 |
| Cr | 19-26 | 23-25 |
| Ni | 19-23 | 21-23 |
| Mo | 7.2-8.5 | 7.2-8 |
| N | 0.45-0.6 | 0.48-0.55 |
| Cu | 0.3-0.8 | 0.3-0.8 |
| Ce | max 0.1 | max 0.05 |

The effect of chromium, molybdenum, and nitrogen upon the resistance to pitting can be described by the following known formula for the Pitting Resistance Equivalent (PRE-value):

$$PRE = \%\ Cr + 3.3 \times \%\ Mo + 30 \times \%\ N \qquad \text{(weight-\%)}$$

Systematic development work has indicated that Cr, Mo, and N have to be combined so that PRE>60 in order to obtain a steel having a crevice corrosion resistance comparable with several of the commercial nickel base alloys existing today. It is therefore a characteristic feature of the invention that the PRE value of the steel is >60.

EXAMPLES

A number of laboratory charges, each having a weight of thirty kilo, were manufactured in a HF-vacuum furnace, alloys 1-15 in Table 2. The materials were hot rolled to 10 mm plates and thereafter cold rolled to 3 mm sheets. The chemical compositions are given in Table 2 and are for alloys 1-12 and 14 control analyses of 3 mm sheets and charge analyses for alloys 13 and 15, respectively. Alloy 16 is a 60 tons production charge which without problems was subjected to continuous casting and subsequent hot rolling to 10 mm plate. Alloys 17 and 18 are two commercial nickel base alloys. All contents relate to weight-%. Besides the elements given in the table, the steels also contained impurities and accessory elements in amounts which are normal for stainless austenitic steels, and for nickel base alloys, respectively. The content of phosphorus was <0.02%, and the content of sulphur was max 0.010%. In alloy 16, the sulphur content was <10 ppm (<0.001%).

TABLE 2

| | | Chemical composition, weight-% | | | | | | | | | |
|---|---|---|---|---|---|---|---|---|---|---|---|
| Alloy | Charge | C | Si | Mn | Cr | Ni | Mo | Cu | N | Ce | PRE |
| 1 | V79 | 0.030 | 0.31 | 3.8 | 21.9 | 20.1 | 6.15 | 0.02 | 0.47 | 0.000 | 56.3 |
| 2 | V121 | 0.022 | 0.37 | 3.9 | 22.1 | 20.2 | 6.31 | 0.13 | 0.51 | 0.014 | 58.2 |
| 3 | V126 | 0.020 | 0.44 | 4.1 | 21.9 | 19.9 | 7.30 | 0.12 | 0.51 | 0.033 | 61.4 |
| 4 | V132 | 0.022 | 0.50 | 3.9 | 22.2 | 20.1 | 8.28 | 0.13 | 0.51 | 0.030 | 64.5 |
| 5 | V134 | 0.025 | 0.54 | 3.7 | 22.4 | 20.2 | 9.35 | 0.13 | 0.59 | 0.004 | 71.1 |
| 6 | V125 | 0.022 | 0.44 | 3.1 | 23.0 | 21.0 | 7.26 | 0.12 | 0.54 | 0.019 | 63.4 |
| 7 | V124 | 0.021 | 0.43 | 2.2 | 24.0 | 21.9 | 7.23 | 0.12 | 0.53 | 0.022 | 64.0 |
| 8 | V127 | 0.019 | 0.45 | 4.2 | 21.9 | 20.0 | 7.23 | 0.49 | 0.52 | 0.027 | 61.5 |
| 9 | V128 | 0.018 | 0.44 | 4.2 | 21.9 | 20.0 | 7.23 | 0.96 | 0.52 | 0.025 | 61.3 |
| 10 | V129 | 0.017 | 0.44 | 4.1 | 21.8 | 20.0 | 7.21 | 1.46 | 0.56 | 0.012 | 62.3 |
| 11 | V80 | 0.031 | 0.32 | 8.0 | 21.5 | 20.0 | 7.25 | 0.02 | 0.63 | 0.009 | 64.3 |
| 12 | V119 | 0.022 | 0.35 | 7.8 | 21.6 | 20.0 | 7.19 | 0.13 | 0.58 | 0.007 | 61.2 |
| 13 | V152 | 0.020 | 0.48 | 2.5 | 21.2 | 20.2 | 7.44 | 0.12 | 0.44 | 0.035 | 58.9 |
| 14 | V150 | 0.017 | 0.46 | 6.0 | 21.4 | 20.4 | 7.47 | 0.13 | 0.56 | 0.076 | 62.9 |
| 15 | V151 | 0.017 | 0.42 | 12.0 | 21.5 | 20.0 | 7.42 | 0.12 | 0.60 | 0.006 | 63.9 |
| 16 | 37 6985[1)] | 0.016 | 0.28 | 2.0 | 24.3 | 22.0 | 7.27 | 0.43 | 0.46 | 0.004 | 62.2 |
| 17 | NXO 649AG | 0.010 | 0.26 | 0.06 | 21.5 | 62.4 | 8.65 | — | — | — | |

TABLE 2-continued

| Alloy | Charge | Chemical composition, weight-% C | Si | Mn | Cr | Ni | Mo | Cu | N | Ce | PRE |
|---|---|---|---|---|---|---|---|---|---|---|---|
| 18 | HT-2760-8 | 0.003 | 0.03 | 0.44 | 15.81 | 56.5 | 15.43 | — | — | — | |

[1] < 10 ppm (< 0.001%) S

MECHANICAL TESTS

Tensile tests, impact tests and hardness measurements were made at room temperature on a 3 mm sheet of two steels of the invention, namely steel No. 6 and No. 16 in Table 2, in the solution heat treated condition. The mean values of two tensile tests/steel, five impact tests/steel and three hardness tests/steel are shown in Table 3 below. The following standard symbols have been used; Rp 0.2: 0.2 proof stress, Rm: ultimate tensile strength, A5. elongation in tensile test, KV: impact strength using V-specimen, and HV20: hardness Vickers, 20 kg.

TABLE 3

| Alloy No. | Rp 0.2 (MPa) | Rm (MPa) | A5 (%) | KV (J/cm$^2$) | HV20 |
|---|---|---|---|---|---|
| 6 | 479 | 861 | 57 | 174 | 226 |
| 16 | 467 | 838 | 58 | 240 | 215 |

From the above given values it can be stated that the steels No. 6 and No. 16 of the invention in comparison with conventional austenitic stainless steels have a high tensile strength and a good toughness in relation to its strength.

STRUCTURE STABILITY

The structure stability of high alloyed austenitic steels usually is a measure of the ability of the steel of maintaining its austenitic structure when subjected to heat treatment in the temperature range 700°-1100° C. This feature is crucial for the weldability of the steel and for the possibility of heat treating the steel in large size dimensions. The greater tendency is to precipitation of secondary phases, the worse is the weldability as well as the possibility of heat treating large size (thick) goods.

Extensive heat treatment tests (isothermal treatments) have established that steels according to the invention has a structure stability at level with that of the commercial steel grade Avesta 254 SMO®, in spite of a clearly higher content of alloying elements. This can be explained by the fact that the higher content of nitrogen suppresses the formation of inter-metallic phases, at the same time as the formation of chromium nitrides is moderate.

CORROSION TESTS

These tests were performed on material taken from the cold rolled 3 mm sheets in the as quenched annealed condition, and on the commercial nickel base alloys 17 and 18, respectively.

The resistance to crevice corrosion and pitting were evaluated in 6% $FeCl_3$-solution according to ASTM G-48. A crevice former of multipel crevice type was used in the crevice corrosion test. In both the tests, the critical temperature was recognized as the temperature where corrosion can be detected on the test surface after exposure to the $FeCl_3$-solution for 24 hours. The critical temperature was measured with an accuracy of ±2.5° C. A high critical temperature always is advantageous, which means that the higher critical temperature is, the better is the corrosion resistance. As reference materials, the commercially available materials of the nickel base alloys 17 and 18 in Table 2 were used during these tests.

The resistance against general corrosion in acids was evaluated by plotting the anodic polarization curves, and from these curves the passivation current density was calculated. A low passivation current density implies that the alloy may be passivated more readily in the acid in question than an alloy having a higher passivation current density. A low passivation current density is always advantageous, since the rate of corrosion of a passivated steel is much lower than the corrosion rate of a steel which has not been possible to be passivated. The three acids which were used in the tests were 20% $H_2SO_4$ at 75° C., 70% $H_2SO_4$ at 50° C., and a phosphoric acid at 50° C.

The phosphoric acid had the following composition:

TABLE 4

| | | | |
|---|---|---|---|
| $P_2O_5$ | 54% | $Al_2O_3$ | 0.6% |
| $H_2SO_4$ | 4.0% | MgO | 0.7% |
| HCl | 1234 ppm | CaO | 0.2% |
| HF | 1.1% | $SiO_2$ | 0.1% |

The following tables show how different, important alloying elements influence the corrosion resistance of those alloys which are shown in Table 2. As far as pitting and crevice corrosion are concerned, it is known that the resistance to these types of corrosion may be influenced in the same manner by an alloying element. Therefore it does not play any role which one of these types of corrosion is studied when the effect of the alloying elements is to be shown.

It is well known that chromium and molybdenum are favourable for the corrosion resistance in most acids, and that manganese has very little effect. It is also known that chromium, and particularly molybdenum, has a favourable effect upon the resistance against pitting and crevice corrosion, but that alloys having very high contents of chromium and molybdenum may contain precipitations in the form of phases which are rich in chromium and molybdenum and that these phases may have an unfavourable influence upon the resistance against crevice corrosion and pitting. It is also known that manganese, through the formation of manganese sulphides, may have an unfavourable effect upon the resistance against crevice corrosion and pitting. For these reasons, the effect of chromium, molybdenum, and manganese has been studied only as far as crevice corrosion or pitting is concerned.

It is also known that the resistance against crevice corrosion and pitting may be impaired in the case of high contents of copper in austenitic steels, but that the copper content also can have importance for the resistance against general corrosion. Therefore also the latter factor has been studied as far as the importance of the content of copper is concerned.

The effect of molybdenum upon the pitting resistance of the alloys is shown in Table 5.

TABLE 5

The influence of the molybdenum content upon the critical pitting temperature

| Alloy No | Mo % | Critical temp °C. |
|---|---|---|
| 2 | 6.31 | 80 |
| 3 | 7.30 | above boiling point |
| 4 | 8.28 | above boiling point |
| 5 | 9.35 | boiling point |
| 17 | 8.65 | 97.5 |
| 18 | 15.43 | above boiling point |

Steel No. 3 and No. 4, which contain 7.30, and 8.28% molybdenum, respectively, have the highest critical temperatures. These steels, which have a composition according to the invention, have a higher critical temperature than the nickel base alloy No. 17 and the same resistance as the nickel alloy No. 18 even at the boiling point.

The effect of chromium upon the crevice corrosion resistance is shown in Table 6.

TABLE 6

The influence of the content of chromium upon the critical crevice corrosion temperature

| Alloy No | Cr % | Critical temp °C. |
|---|---|---|
| 3 | 21.9 | 62.5 |
| 6 | 23.0 | 65 |
| 7 | 24.0 | 65 |
| 17 | 21.5 | 17.5 |
| 18 | 15.81 | 37.5 |

As is apparant by a comparison between alloys No. 3 and No. 6 in Table 6, an increased chromium content has a favourable effect upon the corrosion resistance, but the whole effect has been achieved already at a content of 23% chromium in the alloy. Any further improvement therefore is not gained by alloying the steel with further amounts of chromium, alloy No. 7. The nickel base alloys No. 17 and No. 18 have significantly lower critical temperatures than the alloys of the invention.

The effect of the content of manganese upon the resistance against crevice corrosion is shown in Table 7.

TABLE 7

The influence of the content of manganese upon the critical crevice corrosion temperature

| Alloy No. | Mn % | Critical temp °C. |
|---|---|---|
| 16 | 2.0 | 60 |
| 3 | 4.1 | 62.5 |
| 12 | 7.8 | 45 |

Steel No. 12, which has a high content of manganese, has a significantly lower critical temperature than steel No. 3. The latter steel has a manganese content according to the invention but as far as other elements are concerned it has essentially the same alloy composition and essentially the same PRE-value as steel No. 12.

The effect of the content of copper upon the resistance against pitting is shown in Table 8.

TABLE 8

The influence of the content of copper upon the critical pitting temperature

| Alloy No. | Cu % | Critical temp °C. |
|---|---|---|
| 3 | 0.12 | above boiling point |
| 8 | 0.49 | above boiling point |
| 9 | 0.96 | boiling point |

TABLE 8-continued

The influence of the content of copper upon the critical pitting temperature

| Alloy No. | Cu % | Critical temp °C. |
|---|---|---|
| 10 | 1.46 | 97.5 |

Steels having higher contents of copper than 0.49% thus have a lower critical temperature than steels having lower contents. The impairment of the corrosion resistance is particularly great in the content range between 0.96 and 1.46% Cu.

The effect of copper upon the resistance against general corrosion in acids is shown in Table 9, where the mean value and the variation of two measurements are shown.

TABLE 9

The influence of the content of copper upon the passivation current densities in different acids

| Ally No. | Cu % | Passivation current density $H_2SO_4$ 20% | $H_2SO_4$ 70% | $\mu A/cm^2$ $H_3PO_4$ |
|---|---|---|---|---|
| 3 | 0.12 | 114 ± 35 | 135 ± 5 | 80 ± 4 |
| 8 | 0.49 | 122 ± 8 | 75 ± 8 | 97 ± 23 |
| 9 | 0.96 | 112 ± 7 | 65 ± 2 | 104 ± 5 |
| 10 | 1.46 | 120 ± 3 | 63 ± 2 | 104 ± 10 |

Copper has no significant effect upon the passivation features in 20% $H_2SO_4$ but has a favourable effect in 70% $H_2SO_4$. In the latter case, however, the major part of the improvement has been achieved already at 0.49% Cu. In phosphoric acid, the effect of copper is unfavourable.

The alloy according to the invention therefore has optimal corrosion features at a copper content of about 0.5% since:

- the resistance against crevice corrosion and pitting has not been impaired as compared to the resistance at lower contents of copper;
- the resistance against 70% $H_2SO_4$ has been significantly improved in comparison with the resistance at lower copper contents; and
- the resistance against phosphoric acid has not been impaired as much as at a higher copper contents.

We claim:

1. Austenitic stainless steel having a high tensile strength, a high impact strength, a good weldability and a high corrosion resistance, particularly a high resistance to pitting and crevice corrosion, said steel consisting essentially of in weight-%:

max 0.08 C
max 1.0 Si
more than 0.5 but less than 6 Mn
more than 19 but not more than 28 Cr
more than 17 but not more than 25 Ni
more than 7 but not more than 10 Mo
0.4–0.7 N
from traces up to 2 Cu
0–0.2 Ce
balance essentially only iron, impurities and accessory elements in normal amounts.

2. Steel according to claim 1, consisting essentially of max 0.05 C.

3. Steel according to claim 1, consisting essentially of max 0.03 C.

4. Steel according to claim 1, consisting essentially of 1.0–5.0 Mn.

5. Steel according to claim 1, consisting essentially of 2.0–4.5 Mn.

6. Steel according to claim 4, consisting essentially of 3.0–4.2 Mn.

7. Steel according to claim 1, consisting essentially of max 27 Cr.

8. Steel according to claim 1, consisting essentially of max 26 Cr.

9. Steel according to claim 1, consisting essentially of 7.2–9 Mo.

10. Steel according to claim 9, consisting essentially of max 8.5 Mo.

11. Steel according to claim 9, consisting essentially of max 8.0 Mo.

12. Steel according to claim 1, consisting essentially of 0.45–0.65 N.

13. Steel according to claim 1, consisting essentially of max 0.6 N.

14. Steel according to claim 1, consisting essentially of 0.48–0.55 N.

15. Steel according to claim 1, consisting essentially of 19–24 Ni.

16. Steel according to claim 1, consisting essentially of max 23 Ni.

17. Steel according to claim 1, consisting essentially of 0.3–1.0 Cu.

18. Steel according to claim 1, consisting essentially of 0.4–0.8 Cu.

19. Steel according to claim 1, consisting essentially of max 0.7 Si.

20. Steel according to claim 1, consisting essentially of max 0.5 Si.

21. Steel according to claim 1, consisting essentially of 0.005–0.1% Ce.

22. Steel according to claim 1, wherein the total of $\% Cr + 3.3 \times \% Mo + 30 \times \% N$ is $>60$.

23. Steel according to claim 1, consisting essentially of max 0.01% S.

24. Steel according to claim 1, consisting essentially of less than 10 ppm S.

25. Steel according to claim 1, consisting essentially of in weight-%:

max 0.03 C
max 0.5 Si
2.0–4.5 Mn
19–26 Cr
19–23 Ni
7.2–8.5 Mo
0.45–0.6 N
0.3–0.8 Cu
max 0.1 Ce
max 0.01 S
balance essentially only iron.

26. Steel according to claim 25, consisting essentially of in weight-%:

max 0.03 C
max 0.5 Si
3.0–4.2 Mn
23–25 Cr
21–23 Ni
7.2–8 Mo
0.48–0.55 N
0.3–0.8 Cu
max 0.05 Ce
<0.001 S
balance essentially only iron.

27. Steel according to claim 1, consisting essentially of up to 0.01% of aluminum.

* * * * *